United States Patent [19]

Yoshizaki

[11] Patent Number: 4,612,887

[45] Date of Patent: Sep. 23, 1986

[54] VALVE ACTUATING APPARATUS FOR RESTING THE OPERATION OF A VALVE IN INTERNAL COMBUSTION ENGINE

[75] Inventor: Kouji Yoshizaki, Susono, Japan

[73] Assignee: Toyota Jidosha Kabushiki Kaisha, Aichi, Japan

[21] Appl. No.: 780,685

[22] Filed: Sep. 26, 1985

[30] Foreign Application Priority Data

Dec. 25, 1984 [JP] Japan ..... 59-195440[U]

[51] Int. Cl.[4] ..... F02D 13/06

[52] U.S. Cl. ..... 123/198 F; 123/90.16; 123/90.27; 123/90.39; 123/90.44

[58] Field of Search ..... 123/90.15, 90.16, 90.27, 123/90.44, 198 F, 90.39

[56] References Cited

U.S. PATENT DOCUMENTS

| | | | |
|---|---|---|---|
| 4,151,817 | 5/1979 | Mueller | 123/90.16 |
| 4,203,397 | 5/1980 | Soeters | 123/90.16 |
| 4,204,512 | 5/1980 | Brock | 123/90.16 |
| 4,252,093 | 2/1981 | Hazelrigg | 123/198 F |
| 4,387,680 | 6/1983 | Tsunetomi et al. | 123/198 F |
| 4,537,164 | 8/1985 | Ajiki et al. | 123/90.16 |
| 4,556,025 | 12/1985 | Morita | 123/90.16 |

FOREIGN PATENT DOCUMENTS

| | | |
|---|---|---|
| 57-193903 | 12/1982 | Japan . |
| 57-193904 | 12/1982 | Japan . |
| 59-68109 | 5/1984 | Japan . |
| 59-67506 | 5/1984 | Japan . |
| 59-226216 | 12/1984 | Japan . |

*Primary Examiner*—Ira S. Lazarus

*Attorney, Agent, or Firm*—Parkhurst & Oliff

[57] ABSTRACT

A valve actuating apparatus for intake and exhaust valves in an internal combustion engine having an end pivot type rocker arm. The rocker arm is composed of two arms interconnected by a connecting pin so as to be foldable. A lock pin selectively brings the rocker arm into either a single rigid rocker arm condition or into a foldable rocker arm condition which absorbs the lift of the cam to rest the operation of the valve although the cam continues to rotate. The connecting pin is located so that the displacement of the rocker arm during the foldable movement thereof is minimized.

6 Claims, 5 Drawing Figures

VALVE ACTUATING APPARATUS FOR RESTING THE OPERATION OF A VALVE IN INTERNAL COMBUSTION ENGINE

BACKGROUND OF THE INVENTION

1. Field of the Invention

The present invention relates to a valve actuating apparatus for resting the operation of a valve such as intake and exhaust valves in an internal combustion engine. More particularly, it relates to a valve actuating apparatus which can render only a predetermined intake and/or exhaust valve or valves inoperative at a given engine condition.

2. Description of the Related Art

In a multi-cylinder internal combustion engine, it is known to selectively render only predetermined intake or exhaust valve(s) inoperative in order to cancel out the associated cylinder(s), thereby controlling the total displacement of the effective cylinders, in accordance with the engine load, resulting in the realization of a variable-cylinder internal combustion engine.

Among known valve actuating apparatuses of the kind mentioned above, those closest to the present invention are disclosed, for example, in Japanese Unexamined Utility Model Publication (Kokai) Nos. 59-68109 and 59-67506, in which a rocker arm is composed of two arm elements interconnected by a conneting pin so as to be foldable, with the outer ends of the respective arm elements engaged with the rocker shaft and the valve stem, respectively. A further pin is secured on a stationary bracket and can be inserted into a hole arranged coaxially of the connecting pin. When the further pin secured on the stationary bracket is inserted into the hole, this pin provides a fixed pivot shaft about which only one arm element moves to operate the valve. When the further pin is removed from the hole, the rocker arm is foldable about the connecting pin to absorb the cam lift. In this prior art system, only one arm element extends between the valve stem and the connecting pin so as to have a length sufficient to actually operate the valve and the other arm element is further extended from that sufficient length of the one arm element.

Japanese Utility Model Application Nos. 59-120916 and 59-153107, filed by the same assignee as for the present case, discloses valve actuating apparatus for optionally resting the operation of a valve in an internal combustion engine, including a foldable rocker arm. This rocker arm comprises two arms rotatably interconnected by a connecting pin extending in parallel to a rocker shaft, and a lock pin which dettachably interconnects the two arms. The connecting pin and the locking pin occupy separate positions from each other so that the two arms are brought together as an integral rocker arm to operate the valve when the lock pin interconnects the two arms. The two arms are foldable at the connecting pin to absorb the lift of the cam and thus rest the operation of the valve.

In the rocker arm described above, when the rocker arm is in the foldable condition, it is folded down by contact with a cam nose portion of the cam and returned to a generaglly straight original contour by a return spring when coming into contact with a base circle portion of the cam, this folding cycle being repeated. There arises a requirement in such valve actuating mechanism to minimize the folding displacement of the foldable rocker arm, since the folding motion itself is an idle motion for the valve and may generate undesirable vibration.

SUMMARY OF THE INVENTION

It is an object of the present invention to provide an improved valve actuating apparatus for optionally resting the operation of a valve in an internal combustion engine, which comprises a foldable rocker arm and which can minimize the folding displacement of the foldable rocker arm.

According to the present invention there is provided a valve actuating apparatus optionally resting the operation of a valve in an internal combustion engine having a swing rocker arm which is pivoted at its one end to a rocker arm shaft and at its other end bears against a valve stem of the valve, and a rotatable cam which bears against the rocker arm at an intermediate portion thereof to swing the latter about the rocker arm shaft, said apparatus being applied to said rocker arm which comprises: a first arm having one end pivoted to said rocker arm shaft and the other end extending toward said valve stem; a second arm having one end bearing against valve stem and the other end extending toward said rocker arm shaft; a connecting pin carried by said two arms and extending in parallel to said rocker arm shaft for rotatably interconnecting the respective other ends of said two arms; and a locking pin carried by one of said two arms and engageable with the other of said two arms to selectively interconnect said two arms, whereby said two arms are brought into a generally straight integral swing rocker arm position to operate the valve by following the cam when said locking pin interconnects said two arms and said two arms are foldable at said connecting pin by following the cam to rest the operation of the cam when said locking pin releases said two arms; wherein said cam has a center and a cam nose portion which describes a maximum cam lift circle around said center upon rotation, and said connecting pin is located on or just adjacent to a line passing through said center and an intersecting point between a line tangential to said maximum cam lift circle on the upper surface of the first arm and a line tangential to said maximum cam lift circle on the upper surface of the second arm.

Other feature and objects of the invention will become apparent from the description below.

BRIEF DESCRIPTION OF THE DRAWINGS

The invention will be described below in detail with reference to the accompanying drawings, which show preferred embodiments of the present invention, and in which.

DESCRIPTION OF THE PREFERRED EMBODIMENTS

Figure 2:
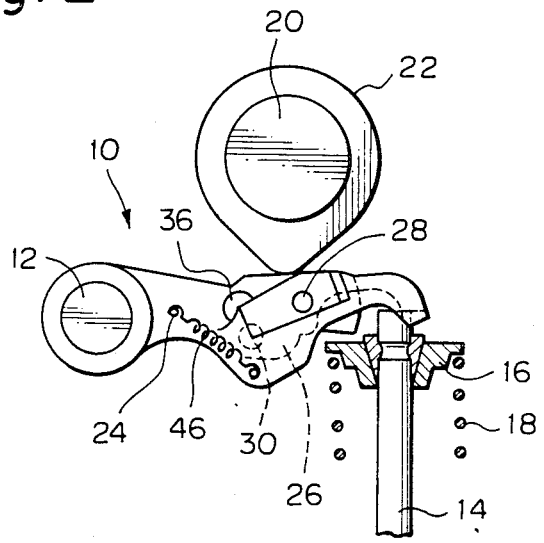
FIG. 2 is side elevation of a valve actuating apparatus shown in an unlocked, i.e., inoperative position, according to the present invention.
Figure 3:
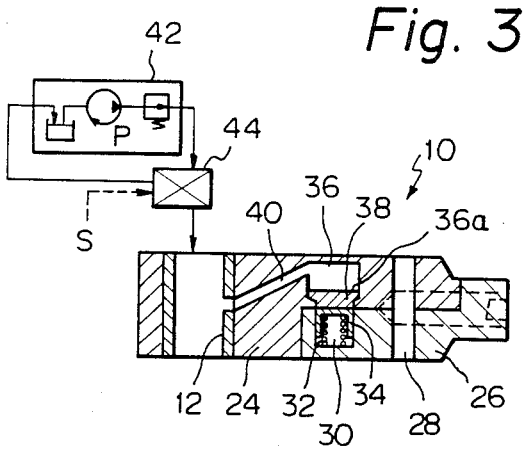
FIG. 3 is a horizontal section of FIG. 2 but in a different condition to that of FIG. 1.

FIGS. 2 and 3 show a first embodiment of the present invention, which is applied to a valve train in an internal combustion engine having an end pivot type swing rocker arm 10, which is pivoted at one end to a rocker arm shaft 2 and at the other end bears against the top of a valve stem 14 of a valve (not shown). The valve may be an intake or exhaust valve of the engine. As is well known, a valve retainer 16 is attached on the valve stem and a valve spring 18 is arranged between the valve retainer 16 and a cylinder head wall (not shown) so as to bias the valve to a closed position. A cam 22 is rigidly secured on a cam shaft 20 in a known rotatable manner and arranged to bear against the rocker arm 10 at an intermediate portion between both ends thereof to swing the rocker arm about the rocker arm shaft 12.

The rocker arm 10, according to the present invention, is composed of two arms 24, 26. The first arm 24 has one end pivoted to the rocker arm shaft 12 and the other end extending toward the valve stem 14. The second arm 24 has one end bearing against the valve stem 14 and the other end extending toward the rocker arm shaft 12. These other ends of the both arms 24 and 25 are rotatably interconnected by a connecting pin 28, which is carried by and passes through the parallel extending ends of the arms 24 and 26. The connecting pin 28 extends in parallel to the rocker arm shaft 12, and allows relative rotation between the arms 24 and 25 about the connecting pin 28 but does not allow them to displace in a direction parallel to the connecting pin 28.

As shown in FIGS. 2 and 3, the first arm 24, pivoted to the rocker arm shaft 12, has a wider portion on the pivoted end side and a narrower portion on the free extreme side. Thus the two arms can slide against each other along the planner sliding surfaces extending perpendicular to the connecting pin 28 as well as generally cylindrical sliding surface around the connecting pin 28, defined at the free external end of the second arm 26 and the free external end of the wider portion of the first arm 24, respectively. A lock means is provided transversely of, or across the sliding surfaces. In the first embodiment illustrated in FIGS. 2 and 3, the lock means is provided at the planar sliding surfaces extending perpendicular to the connecting pin 28. Alternately, in the second embodiment illustrated in FIGS. 4 and 5, the lock means is provided at the cylindrical sliding surfaces around the connecting pin 28.

Figure 4:
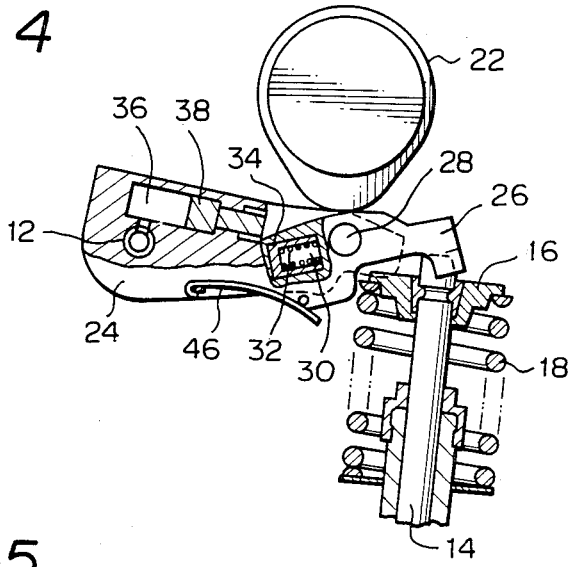
FIG. 4 is a partially sectioned side elevation of a valve actuating apparatus according to the second embodiment of the present invention.
Figure 5:
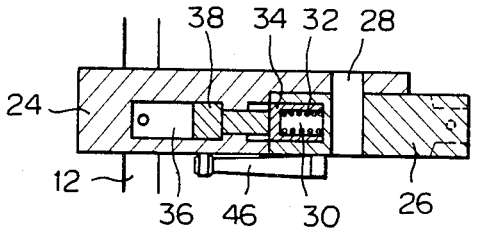
FIG. 5 is a horizontal section of FIG. 4 but in a diferent condition to that of FIG. 4.

In FIGS. 2 and 3, and similarly in FIGS. 4 and 5, the lock means comprises a lock pin 34 which is slidably inserted in a cylinder 30 provided in the second arm 26 and biased toward the first arm 24 by a biasing spring 32. The lock means further comprises a cylinder 36 into which the lock pin 34 can be partially inserted to interconnect the two arms 24 and 26 when the two cylinders 30 and 36 are aligned. A stepped piston 38 is fitted in the cylinder 36 in the first arm 24. The cylinder 36 has a step to receive the stepped piston 38, so that the front surface of the piston 38 reaches and constitutes a part of the sliding surface as above stated when it is advanced. A hydraulic oil is introduced in the cylinder 36 behind the piston 38 through a channel 40 communicating with an oil passage defined by the hollow rocker arm shaft 12. The pressurized oil can be fed from a source of the pressurized oil 42 through a solenoid-operated valve 44 which can be controlled by a signal S representative of the engine load and speed. Further, an arm return spring 46 is provided between the two arms 24 and 26 to return the rocker arm 10 toward the cam 22 to maintain the rocker arm 10 in contact with the cam 22 while the rocker arm 10 is folded about the connecting pin 28, as will be described hereafter. The spring 46 in FIG. 2 is a coil spring, whereas the spring 46 in FIG. 4 is a torsional spring.

With the arrangement described above, the position of the connecting pin 28 is specially selected, according to the present invention. As will be clear trom the above, the cam 22 normally has a center 0 and a cam nose portion (seen in FIG. 2) which descrrbes the maximum cam lift circle 50 upon rotation of the cam 22. The connecting pin 28, which is carried by the two arms 24 and 26, is located on or just adjacent to a line 58 which passes through the center 0 of the cam 22 and a point 56. The point 56 is an intersecting point between two lines 52 and 56. The line 52 extends on the upper surface of the first arm 24 perpendiculr to the rocker arm shaft 12 when the upper surface of the first arm 24 is tangential to the maximum cam lift circle 50. The other line 54 extends on the upper surface of the second arm 26 perpendicular to the rocker arm shaft 12 when the upper surface of the second arm 24 is tangential to the maximum cam lift circle 50. It is assumed that the points and lines in this discussion assume a single vertical plane. It is believed that this disposition of the connecting pin 28 relative to the cam 22, arms 24 and 26, rocker arm shaft, and the valve stem 14, will attain the minimum folding displacement, i.e., angular displacement of the first arm 24 about the rocker arm shaft 12 and/or angular displacement of the second arm 26 on the valve stem 14.

The operation of the valve actuating apparatus for optionally resting the operation of the valve will now be described.

Figure 1:
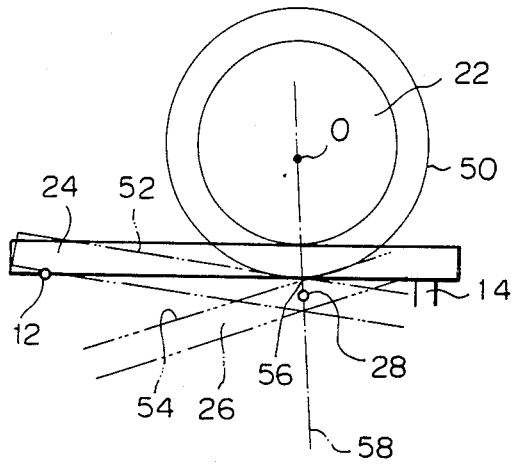
FIG. 1 is a diagram illustrating the location of a connecting pin as embodied in FIGS. 2 to 5, according to the present invention.

The cam 22 continues to rotate synchronously with the engine. When the operation of the valve is to be rested or the valve is to be rendered inoperative for cancelling out one or several of the cylinder(s) in the multi-cylinder engine or for resting one of the multiple intake (exhaust) valves in one cylinder, the control unit (not shown) controls the solenoid-operated valve 44 into an open position and the pressurized oil from the source 42 is introduced into the cylinder 36. The hydraulic oil then exerts pressure against the piston 38 which forces the locks pin 34 out of the cylinder 36, the front surface of which reaches the adjoining sliding surfaces of the arms 24 and 26. At this moment, the lock pin 34 releases the interlock between the two arms 24 and 26, and the arms 24 and 26 become rotatable about the connecting pin 28. In this condition, the rocker arm 10 is foldable by following the cam 22 which exerts a downward pressure on one or both of the arms 24 and 26, because both ends of the rocker arm 10 are supported by the rocker arm shaft 12, and the spring force of the valve return spring 18 is greater than that of the arm return spring 46. Thus the external end of the second arm 26 does not depress the valve stem 14 and the normal rotation movement of the cam 22 is not transferred to the valve stem 14 but absorbed by the folding rocker arm 10. In this way, the operation of the valve is rested and the valve is maintained in a closed position. The arms 24 and 26 repeat the bending motion by following the motion of the cam 22 and the arm return spring 46, with the external end of the second arm 26 bearing against the top surface of the valve stem 14 in sliding contact therebetween. As the connecting pin 28 is so located as described above, the folding displacement of the foldable rocker arm 10 is relatively small, thus the motion of the rocker arm 10 is moderate. If the position of the connecting pin 28 were offset toward the lefthand or righthand side from the position in FIG. 1, it will be understood that the motion of one of the arm would become more abrupt. If the motion of the second arm 26 becomes more abrupt, the second arm 26 may interfere with the valve stem and the sliding displacement of the second arm 26 relative to the valve stem 14 may increase.

When the engine condition changes, for example, the engine load becomes greater, the intake (exhaust) valve is to be returned to the operation state by controlling solenoid-operated valve into a closed position so as to release the pressure in the cylinder 36. Then the spring force of the bias spring 32 in the cylinder 30 overcomes the pressure in the corresponding cylinder 36, with the result that the lock pin 34 partially enters the facing cylinder 36 to interlock the two arms 24 and 26 while the rocker arm 10 engages with the base circle portion of the cam 22 in which the lock pin 34 aligns the cylinder 36. Thus the two arms 24 and 26 are interconnected at two separate positions by the connecting pin 28 and the lock pin 34, the two arms 24 and 26 now cannot rotate or fold at the connecting pin 28. In this way, the two arms 24 and 26 are brought to a single generally straight integral rocker arm 10 condition. In this condition, the motion of the cam 22 is transferred to the valve stem 14 through the rigid rocker arm 10 to operate the valve which opens or closes synchronously with the engine.

As explained above, a valve actuating apparatus for optionally resting the operation of a valve in an internal combustion engine, according to the present invention, makes it possible for the folding displacement of the foldable rocker arm to be minimized, which mitigates vibration and prevents an arm end bearing against the valve stem from failing down therefrom.

I claim:

1. A valve actuating apparatus for optionally resting the operation of a valve in an internal combustion engine having a swing rocker arm which is pivoted at one end to a rocker arm shaft and at another end bears against a valve stem of the valve, and a rotatable cam which bears against the rocker arm at an intermediate portion thereof to swing the latter about the rocker arm shaft, said apparatus being applied to said rocker arm which comprises:

a first arm having one end pivoted said rocker arm shaft and the other end extending toward said valve stem;

a second arm having one end bearing against a valve stem and the other end extending toward said rocker arm shaft;

a connecting pin carried by said two arms and extending in parallel to said rocker arm shaft for rotatably interconnecting the respective other ends of said two arms; and a locking pin carried by one of said two arms and engagable with the other of said two arms to selectively interconnect said two arms, whereby said two arms are brought into a generally straight integral swing rocker arm condition to operate the valve by following the cam when said locking pin interconnects said two arms and said two arms are foldable at said connecting pin by following the cam to rest the operation of the cam when said locking pin releases said two arms; wherein said cam has a center and a cam nose portion which describes a maximum cam lift circle around said center upon rotation, and said connecting pin is located on or just adjacent to a line passing through said center and an intersecting point between a line tangential to said maximum cam lift circle on the upper surface of the first arm and a line tangential to said maximum cam lift circle on the upper surface of the second arm.

2. An apparatus according to claim 1, wherein said two arms are biased by a spring toward the cam.

3. An apparatus according to claim 2, wherein said two arms have cooperating sliding surfaces, and wherein said locking pin is slidably inserted in a cylinder provided in one of said two arms transversely of said sliding surfaces and can be further slidably inserted in a corresponding cylinder provided in the other of said two arms.

4. An apparatus according to claim 3, wherein said locking pin is hydraulically operated.

5. An apparatus according to claim 4, wherein said sliding surfaces extend planarly and perpendicular to said connecting pin.

6. An apparatus according to claim 4, wherein said sliding surfaces extend generally cylindrically around said connecting pin.

* * * * *